United States Patent [19]

Davis

[11] 4,374,023

[45] Feb. 15, 1983

[54] PROCESS FOR RECOVERING HYDROCARBONS FROM A DIATOMITE-TYPE ORE

[75] Inventor: Bruce W. Davis, Fullerton, Calif.

[73] Assignee: Chevron Research Company, San Francisco, Calif.

[21] Appl. No.: 315,317

[22] Filed: Oct. 26, 1981

[51] Int. Cl.[3] ..... C10G 1/00

[52] U.S. Cl. ..... 208/11 LE; 208/8 LE

[58] Field of Search ..... 208/8 LE, 11 LE

[56] References Cited

U.S. PATENT DOCUMENTS

| | | | |
|---|---|---|---|
| 2,202,901 | 6/1940 | Dreyfus | 208/8 LE |
| 3,079,326 | 2/1963 | Neuworth | 208/45 |
| 3,254,959 | 6/1966 | Fallgatter et al. | 208/8 LE X |
| 3,846,276 | 11/1974 | Walker | 208/11 |
| 3,850,477 | 11/1974 | Aldrich et al. | 208/8 LE |
| 4,017,377 | 4/1977 | Fairbanks et al. | 208/11 LE |
| 4,046,668 | 9/1977 | Faraosu et al. | 208/11 LE |
| 4,057,486 | 11/1977 | Meodus | 208/11 LE |
| 4,110,194 | 8/1978 | Peterson et al. | 208/11 LE |
| 4,167,490 | 9/1979 | Karnofsky | 208/8 E |
| 4,180,452 | 12/1979 | Sinor | 208/8 LE |
| 4,338,184 | 7/1982 | Maa et al. | 208/8 LE |

FOREIGN PATENT DOCUMENTS

| | | | |
|---|---|---|---|
| 621844 | 6/1961 | Canada | 208/11 LE |
| 918590 | 1/1973 | Canada | 208/11 LE |

OTHER PUBLICATIONS

Utah Tar Sands to be Developed, Alford et al., Hydrocarbon Processing, Jun. 1981, pp. 127–130.

*Primary Examiner*—Delbert E. Gantz
*Assistant Examiner*—William G. Wright
*Attorney, Agent, or Firm*—D. A. Newell; E. J. Keeling; A. Stephen Zavell

[57] ABSTRACT

A process for recovering hydrocarbons from a diatomite-type ore which comprises contacting the diatomite ore with a $C_4$–$C_{10}$ alcohol and thereafter contacting the diatomite ore-alcohol mixture with an aqueous alkaline solution to separate a hydrocarbon-alcohol phase and an alkaline aqueous phase containing the stripped diatomite ore. Thereafter, the alcohol is distilled off from the hydrocarbon phase and recycled back into the initial process.

21 Claims, No Drawings

PROCESS FOR RECOVERING HYDROCARBONS FROM A DIATOMITE-TYPE ORE

BACKGROUND OF THE INVENTION

The present invention relates to a process of extracting hydrocarbons from a tar sand. More specifically, the present invention relates to the extraction of hydrocarbons from a diatomite hydrocarbon-rich ore.

Diatomite-hydrocarbon ores and similar materials are different from the vast majority of grainy or sand-like tar sands. Diatomite ores are composed of hollow silicaceous skeletons of single-celled animals referred to as "diatoms." A diatomite-like ore is defined as a material which has a surface area and structure which is substantially similar to diatomaceous earth. In ocean sediments, hydrocarbon-rich diatomaceous earth is sometimes referred to as "diatom ooze" which is normally found at a depth of about 1500 fathoms and comprises the empty shells of diatoms. The porous structure and extremely high surface area of diatomaceous earth makes extraction and recovery of the hydrocarbons difficult. Although diatomite ore is sometimes classified as a tar sand, i.e., sand cemented by a bitumen too viscous to be recovered by conventional crude oil production methods, the properties of the ore preclude application of most hydrocarbon solvent or hot water-wash techniques. Solvents which displace the hydrocarbons tend to be trapped in the diatomaceous earth structure, thus rendering recovery uneconomical. Steam or aqueous hot-wash techniques have difficulty reaching the surface of the diatomaceous ore to remove the hydrocarbons therefrom. Thus, it would be highly desirable to have a process which can extract the hydrocarbons from the diatomaceous ore or diatomaceous-like ore without entraining diatoms in the extracted hydrocarbons and wherein the solvent and the extracted hydrocarbons are easily separable and the solvent can be reused in the recovery process.

SUMMARY OF THE INVENTION

I have invented a process for recovering hydrocarbons from diatomaceous-like ores which comprises contacting the diatomite ore containing hydrocarbons with an effective amount of a $C_4$–$C_{10}$ alcohol and thereafter contacting the alcohol-wet ore with an aqueous alkaline solution to separate the mixture into a hydrocarbon-alcohol phase and an alkaline aqueous-diatomaceous ore fraction. The hydrocarbon can thereafter be recovered from the hydrocarbon-alcohol phase.

DETAILED DESCRIPTION OF THE INVENTION

The diatomite ore containing hydrocarbons is contacted with an effective amount of a $C_4$–$C_{10}$ alcohol. The alcohols are selected such that the alcohols are slightly soluble or insoluble in water but still capable of removing the hydrocarbon from the diatomaceous ore surface.

The $C_4$–$C_{10}$ alcohol can be a straight- or branched-chain aliphatic such as n-butanol, 1-butanol, 1-, 2-, or 3-pentanol, t-butanol, 1-, 2-, 3-, or 4-heptanol, and the like; an aromatic such as phenylcarbinol, ortho, meta and/or para tolyl carbinol, methylphenylcarbinol, dimethylphenylcarbinol, and the like; an alicyclic such as cyclohexanol, cyclopentanol, and the like; an alicyclic alcohol substituted with a straight- or branched-chain alkyl group wherein the OH group is either on the ring or the alkyl group such as 2-methyl-cyclohexanol, 2-cyclohexylethanol, and the like; an aromatic-alicyclic substituted with an aliphatic group in either ring such as

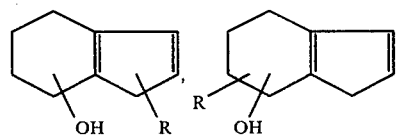

where R is methyl; an unsaturated straight- or branched-chain alcohol such as but-1-en-4-ol, 4-penten-1-ol, 5-methyl-3-hexen-1-ol, and the like; and mixtures thereof. Other examples include $\alpha$-, $\beta$-, or $\gamma$-terpineol. In terms of preferred aliphatic alcohols, n-butanol is more preferred than isobutanol which is more preferred than t-butanol. Most preferred is n-hexanol or n-heptanol.

"An effective amount of alcohol" is defined to mean that amount of alcohol which can thoroughly wet the diatomite ore. With respect to the wetting of the diatomaceous ore, the ratio of alcohol to diatomaceous ore is from about 1 to 1 to about 1 to 5 and most preferably 4 to 5. Ideally, as little alcohol is used as is necessary to thoroughly wet the diatomaceous ore because this reduces the cost of the overall process.

The contacting of the ore with the alcohol can be by spraying the ore with the alcohol or by mixing the ore with the alcohol or other methods known in the art. There are no particular size limitations for the diatomite ore to be contacted with alcohol although the finer the ore, the greater the wetting and the more thorough will be the separation and recovery of the hydrocarbons attached thereto. Preferably, the diatomite ore is ground to a size less than about 1 mesh and most preferably to be finer than about 10 mesh.

After contacting the ore with alcohol, the alcohol-wet ore composition is contacted with an aqueous alkaline solution. The alcohol to alkaline aqueous solution ratio is from about 1 to 2 to about 1 to 16 and preferably about 1 to 4. The contacting can be by passing the alcohol-wet ore into an aqueous alkaline bath, by countercurrent mixing, or by placing the alcohol-wet ore into an aqueous alkaline bath and mixing the composition and the like. Of course, methods which result in a continuous process, such as the countercurrent mixing of the diatomite ore-alcohol composition with the aqueous alkaline solution, are preferred. When the diatomaceous ore-alcohol mixture is contacted with the aqueous alkaline solution, the contacting step is preferably sufficient to separate the hydrocarbon from the diatomaceous ore but insufficient to entrain or entrap the fines of the diatomaceous ore in the hydrocarbon phase. The contacting or mixing should not be so violent so as to form an emulsion because this greatly lengthens the time necessary to separate the two phases. Generally, the contacting is from about 10 seconds to about 15 minutes.

The contacting of the aqueous alkaline solution to the alcohol-wet diatomite ore causes a separation of the hydrocarbons from the diatomite ore. The composition separates into a hydrocarbon-alcohol phase and an aqueous alkaline-diatomaceous ore fraction. Aqueous alkaline is defined as a solution with a pH which is at least a pH of about 9, and preferably greater than 11, and most preferably about 13. Any suitable compound which can raise the pH to the preferred range, such as condensed silicates or phosphates, NaOH or other hydroxides, is within the scope of the invention. The hydroxide is present in an amount in excess of about 1 g per 100 ml and preferably about 2 g per 100 ml.

Condensed silicates are preferred and most preferred are the alkali metal silicates. A preferred range of sodium meta-silicate is from 1.5 percent to 4.5 percent. A most preferred embodiment is where the aqueous alkaline solution contains 3 percent sodium meta-silicate. Condensed silicates or phosphates are defined as compounds or polymers of silicates or phosphates known as polyphosphates and polysilicates as taught in Sections 28.15 and 28.16 of *General Chemistry,* by Paul et al, pages 653–660, and the polymer structures disclosed on page 431 of *Chemistry,* by Charles E. Mortimer, said material incorporated herein by reference.

Upon separation of the mixture into two phases, the alcohol-hydrocarbon phase which is lighter than the water-diatomaceous ore phase, is either skimmed off or decanted from the top of the aqueous alkaline solution. The separation occurs readily at room temperature. Preferably, the solution temperature is from about 20° C. to 95° C., and most preferably 32° C. or higher.

Thereafter, the alcohol, which has a lower boiling point than most of the hydrocarbon components, is flash distilled off or distilled by other means known in the art and recycled back into the initial step of contacting the diatomite ore.

The diatomaceous ore which falls to the bottom of the aqueous alkaline solution is removed and after adding make-up components, if necessary, the aqueous alkaline solution is returned to extract virgin alcohol-wet diatomaceous ore.

Having described the process, the invention will be more clearly illustrated by referring to the following examples. It should be understood that the examples are illustrative only and not intended to limit the scope of the invention. Modifications which would be obvious to one of ordinary skill in the art are contemplated to be within the scope of the invention.

EXAMPLES

Example 1

A diatomite ore was ground to finer than 10 mesh. 25 g of the ground diatomite ore was added to a beaker containing a magnetic stir bar. The ore had an oil content estimated at about 28 percent. 20 g of 1-butanol was added to the beaker and permitted to thoroughly wet the diatomaceous ore. Thereafter, 80 g of a 3 percent sodium meta-silicate, based on a formula weight $Na_2SiO_3$, a product of J. T. Baker Company, was added to the beaker and the contents of the beaker were stirred for 1 minute with a magnetic stirrer. Finally, the beaker was covered with a watch glass and then placed in a temperature bath which was regulated to a temperature of about 32° C., i.e. 90° F., for 4 hours to separate the mixture into a hydrocarbon-alcohol phase floating on an aqueous alkaline water phase with the diatomaceous ore at the bottom of the aqueous alkaline phase.

Upon separation and measurement, 72 percent of the oil was recovered and separated.

Examples 2–8

The procedure outlined in Example 1 was carried out with the exception of the substitution of the alcohols listed below in Table I for 1-butanol. Examples 5–8 were stirred for 30 seconds instead of 1 minute.

TABLE I

| Example | Alcohol | % Oil Recovery |
|---|---|---|
| 1 | 1-butanol | 72 |
| 2 | 2-butanol | 51 |
| 3 | 1-pentanol | 81 |
| 4 | 1-hexanol | 90 |
| 5 | 1-hexanol | 91 |
| 6 | 1-octanol | 88 |
| 7 | 1-decanol | 41 |
| 8 | benzyl alcohol | 38 |

Example 11

25 g of a diatomite ore ground to a 10 mesh or finer was added to a beaker. 20 g of n-butanol was added to the beaker. Thereafter, 80 g of a 2 g NaOH/100 ml solution was added to the beaker. The beaker was covered with a watch glass and placed in a temperature bath at 32° C. for 4 hours. The alcohol oil layer was separated and the oil recovered; 51 percent of the oil was recovered.

Examples 12–13

The procedure of Example 11 was followed; however, the concentration of NaOH was increased as indicated below in Table II.

TABLE II

| Example | NaOH Conc. | % Oil Recovery |
|---|---|---|
| 11 | 2 g/100 ml | 51 |
| 12 | 3 g/100 ml | 47 |
| 13 | 4 g/100 ml | 43 |

COMPARATIVE EXAMPLES

Example A 25 g of diatomite ore having a particle size of 10 mesh or finer was added to a beaker. A mixture of 20 g of n-butanol and 80 g of 3 percent sodium meta-silicate was added together to the ore. The oil recovery was only 13 percent.

Example A'

The same procedure as Example A was followed except the mixture was 10 g n-butanol and 90 g of 3 percent sodium meta-silicate. The oil recovery was 26 percent.

This demonstrates that the separate steps are superior to the mixture of alcohol and alkaline wash used together to recover oil.

Example B

The procedure was carried out in accordance with Example 11 with the exception that the hydroxide concentration was 1 g/100 ml and the percent oil recovery was 14 percent.

Example C

The procedure of Examples 5–8 was followed except methyl ethyl ketone was substituted for the alcohol. The oil recovery was 25 percent.

Example D

The procedure of Example 11 was followed except 80 g of water containing varying amounts of from 1 g $MgCl_2$/100 ml to 20 g $MgCl_2$/100 ml was added in separate beakers containing the alcohol. The solutions were essentially neutral. Essentially no oil was recovered.

Example E 25 g of diatomite ore was placed in a beaker. Mixtures of 10 g straight-chain $C_2$ and $C_5$, $C_3$ and $C_5$, and $C_4$ and $C_5$ alcohols and 90 g $H_2O$ were added to the ore. No separation of the hydrocarbon was observed.

Example F

When 25 g of diatomite ore was added to beakers containing surfactants such as Triton X-165 and X-45, products of Rohm & Haas, wherein the surfactant was present in an amount of 1 g for 89 g of $H_2O$, either no hydrocarbons were recovered or single-phase emulsion formed.

I claim:

1. A process for recovering hydrocarbons from diatomite ore comprising:

(a) contacting a diatomite ore containing hydrocarbons with an effective amount of a $C_4$–$C_{10}$ alcohol or mixture of alcohols;

(b) contacting the diatomite ore-alcohol mixture with an aqueous alkaline solution to separate the mixture into a hydrocarbon phase and an alkaline aqueous-diatomaceous ore fraction; and (c) recovering the alcohol-hydrocarbon phase from step (b).

2. The process according to claim 1 wherein the $C_4$–$C_{10}$ alcohol is a $C_4$–$C_{10}$ straight- or branched-chain aliphatic, alicyclic, aromatic, substituted aromatic, substituted alicyclic, aromatic-alicyclic, olefinic, or mixtures thereof.

3. The process according to claim 1 wherein the alcohol is a straight-chain or a branched-chain alcohol.

4. The process according to claim 3 wherein the alcohol is a straight-chain $C_4$–$C_{10}$ alcohol.

5. The process according to claim 1 wherein the aqueous alkaline solution has a pH greater than about pH 9.

6. The process according to claim 5 wherein the aqueous alkaline solution has a temperature of from about 20° C. to about 95° C.

7. The process according to claim 6 further comprising settling the mixture of step (b) for a sufficient time to separate said mixture into two phases prior to recovery of the alcohol-hydrocarbon phase.

8. The process according to claim 7 wherein the pH is obtained by adding a condensed silicate, a condensed phosphate, a hydroxide, an alkali metal silicate, or mixtures thereof, to an aqueous solution.

9. The process according to claim 8 wherein the aqueous alkaline solution contains 3 percent sodium metasilicate.

10. The process according to claim 6 further comprising:

(d) separating the alcohol solvent from the hydrocarbon and recycling the alcohol into step (a).

11. The process according to claim 10 wherein the alcohol is separated from the hydrocarbons by distillation.

12. The process according to claim 6 wherein the ratio of alcohol to alkaline aqueous solution is from about 1 to 2 to about 1 to 16.

13. The process according to claim 12 wherein the ratio of alcohol to alkaline aqueous solution is about 1 to 4.

14. The process according to claim 12 wherein the alcohol to diatomaceous ore ratio is from about 1 to 1 to about 1 to 5.

15. The process according to claim 14 wherein the alcohol to diatomaceous ore ratio is about 4 to 5.

16. The process according to claim 15 wherein the alcohol is n-hexanol or n-heptanol.

17. The process according to claim 14 wherein the contacting of step (b) is from about 10 seconds to about 15 minutes.

18. The process according to claim 17 wherein the contacting is by mixing the diatomaceous ore-alcohol mixture with the aqueous alkaline solution.

19. The process according to claim 18 wherein the mixing is countercurrent mixing.

20. The process according to claim 19 wherein the alcohol is n-hexanol, the aqueous alkaline solution contains 3 percent by weight sodium meta-silicate, the mixing of step (b) is for about 30 seconds, the ratio of alcohol to ore is about 4 to 5, and the ratio of alcohol to aqueous alkaline solution is about 1 to 4.

21. The process according to claim 1, 5, 7, 10, 12, or 18 wherein the diatomaceous ore tailings are separated from the alkaline aqueous solution and said alkaline aqueous solution is recycled back into step (b).

* * * * *